US005319836A

United States Patent [19]

Ida

[11] Patent Number: 5,319,836

[45] Date of Patent: Jun. 14, 1994

[54] BUCKLE ASSEMBLY

[75] Inventor: Kazuo Ida, Toyama, Japan

[73] Assignee: Yoshida Kogyo K. K., Tokyo, Japan

[21] Appl. No.: 116,589

[22] Filed: Sep. 7, 1993

[30] Foreign Application Priority Data

Sep. 9, 1992 [JP] Japan ..... 4-069373[U]

[51] Int. Cl.[5] ..... A44B 11/00

[52] U.S. Cl. ..... 24/625; 24/614; 24/616

[58] Field of Search ..... 24/614, 630, 663, 664, 24/625, 633, 616, 590, 591, 592, 593, 594, 595

[56] References Cited

U.S. PATENT DOCUMENTS 4,035,877 7/1977 Brownson et al. ..... 24/664
4,912,950 4/1990 Crowle ..... 24/614
5,144,725 9/1992 Krauss ..... 24/625

FOREIGN PATENT DOCUMENTS 63-20334 6/1988 Japan .

*Primary Examiner*—Victor N. Sakran
*Attorney, Agent, or Firm*—Hill, Steadman & Simpson

[57] ABSTRACT

A buckle comprises a plug member and a socket member relasably engageable therewith, the plug member including a retainer means in the form of a disc-like collet and a stopper means adapted to hold the retainer means stationery after the latter is rotated into position in the body of the plug member. The retainer means is normally urged upwardly by a coil spring and serves as a fulcrum about which the plug member and the socket member can be moved rotatably relative to each other.

3 Claims, 6 Drawing Sheets

BUCKLE ASSEMBLY

BACKGROUND OF THE INVENTION

1. Field of the Invention

This invention relates to a buckle and more particularly a buckle of the type comprising a male member and a female member which are rotatable relative to each other.

2. Prior Art

A typical prior art buckle of the type mentioned is disclosed in Japanese Utility Model Publication No. 63-20334 in which the buckle is made up from a plug member having a resilient engaging tongue integral therewith and a socket member having a circular window dimensioned to receive the tongue. When coupling the two members, the tongue is urged to flex downwardly about an axis defined by a portion thereof connected to the body of the plug member and returns resiliently to its original position upon entry into the window. When separating the two members, the tongue is depressed to sink below the level of the window so that the plug member can be pulled apart from the socket member. Repeated flexing action of the tongue during engaging and disengaging of the plug and socket members over extended periods of time would lead to reduced resiliency or even breakage of the connecting portion between the tongue and the plug body. This problem may be solved by literally increasing the thickness of the connecting portion of the tongue or otherwise reinforcing the same, which would however in turn render the tongue less resilient or pliable, resulting in difficult, if not impossible, manipulation of the plug member relative to the socket member.

SUMMARY OF THE INVENTION

It is therefore a primary object of the present invention to provide an improved buckle which will eliminate or alleviate the aforementioned difficulties of the prior art and which comprises a plug member and a socket member, the two members being so constructed as to ensure mutual coupling and uncoupling with utmost ease and being further movable rotatably relative to each other when assembled.

The above and other objects and features of the invention will be better understood from the following detailed description taken in connection with the accompanying drawings which illustrate by way of example a preferred embodiment. Like reference numerals refer to like or corresponding parts throughout the several views.

According to the invention there is provided a buckle which comprises a plug member and a socket member releasably engageable therewith, the plug member having a circular window and including a retainer means resiliently supported to be movable through the window vertically with respect to the plane of the buckle and a stopper means adapted to hold the retainer means in place against rotation, and the socket member having a chamber dimensioned to receive the plug member and a circular window dimensioned to receive the retainer means movably therein, the arrangement being that the plug member and the socket member are rotatable relative to each other about the retainer means in a plane parallel to the plane of the buckle.

DETAILED DESCRIPTION OF THE INVENTION

Figure 1:
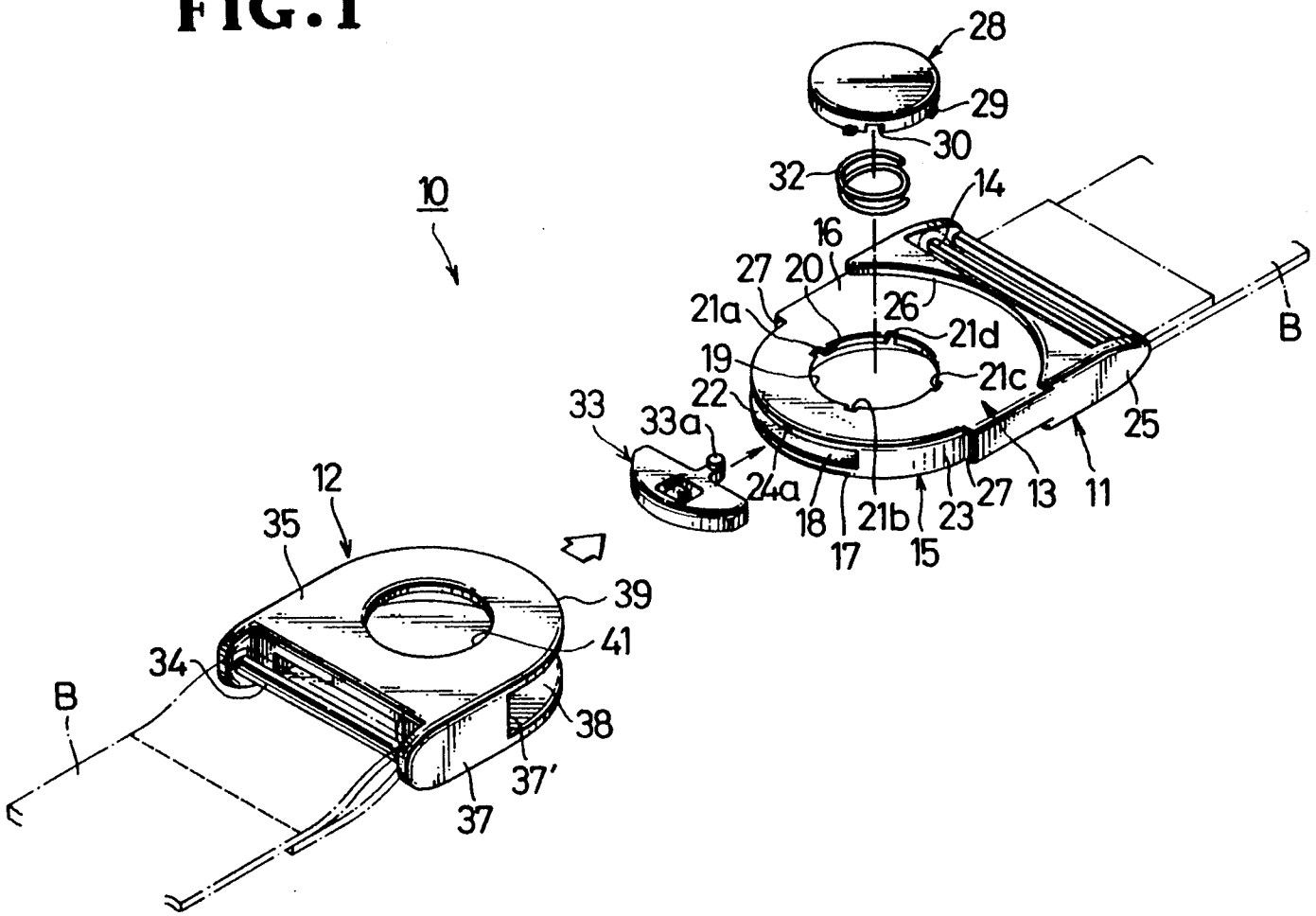
FIG. 1 is an exploded perspective view of a buckle embodying the invention.

Referring now to the drawings and FIG. 1 in particular, there is shown a buckle 10 constructed in accordance with the principles of the invention, the buckle 10 essentially comprising a plug member 11 and a socket member 12 releasably engageable therewith. The plug member 11 has a body 13 including a belt retainer 14 at one end for retaining one free end of a belt or the like B in a manner well known in the art. The plug body 13 has an engaging tongue 15 in the form of a generally circular disc formed by an upper plate 16 and a lower plate 17 defining therebetween a chamber 18. A circular window 19 is formed centrally in the upper plate 16 in communication with the chamber 18 and defined by a circular peripheral edge 20 having equidistantly spaced therearound a plurality (four in the illustrated case) of engaging notches 21*a*–21*d*.

An arcuate inlet mouth 22 is formed in a portion of a peripheral end plate 23 diametrically opposite to and remote from the belt retainer 14 and in communication with the chamber 18, the end plate 23 connecting between the upper and lower plates 16 and 17 of the engaging tongue 15. An elongated guide slit 24*a* is formed in the lower surface of the upper plate 16 centrally of the inlet mouth 22, and a locking aperture 24*b* is formed in the upper surface of the lower plate 17 in registry with the guide slit 24*a*.

Figure 2:
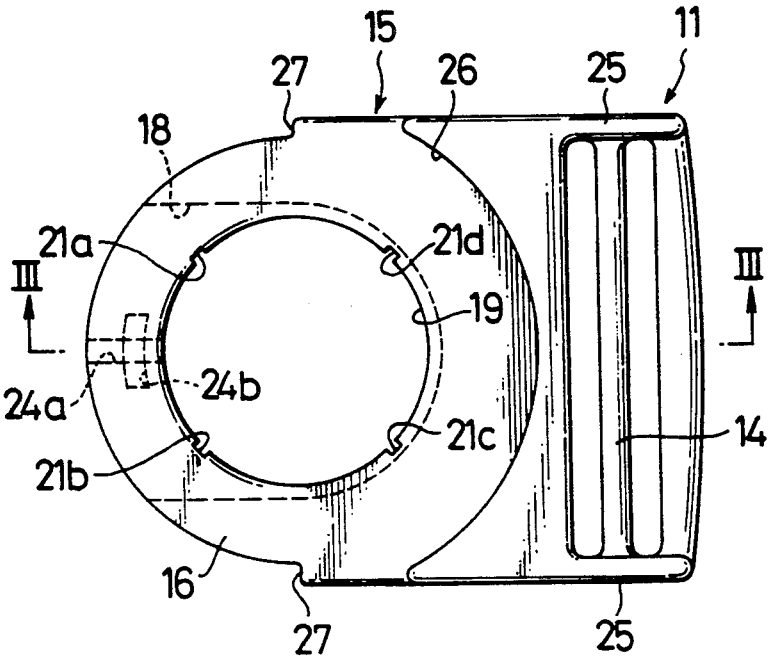
FIG. 2 is a plan view of a plug member constituting a male part of the buckle.
Figure 3:
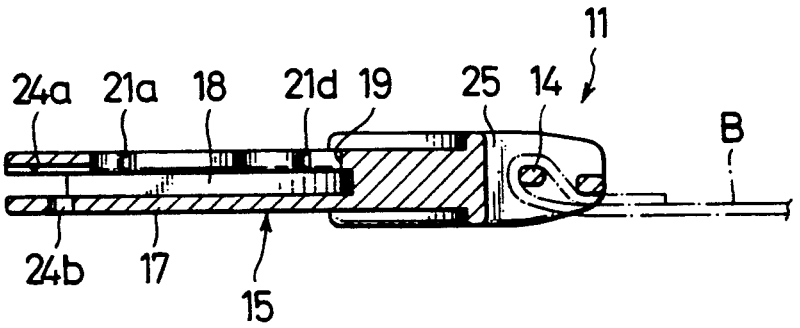
FIG. 3 is a longitudinal cross-sectional view taken on the line III—III of FIG. 2.

The plug body 13 has a pair of flanges 25, 25 having respective one ends formed integral with the belt retainer 14, each of which flanges is reduced in thickness from both sides so as to lie flush with the upper and lower surfaces of the upper and lower plates 16 and 17 and consequently provide an arcuate abutment 26 on each side of the engaging tongue 15 adjacent to the belt retainer 14 as better shown in FIGS. 2 and 3. The flanges 25, 25 have respective opposite ends terminated to provide end abutments 27, 27 disposed substantially diammetrically centrally across the circular window 19 of the plug member 11 as better shown in FIG. 2.

Designated at 28 is a retainer means in the form of a disc-like collet to be mounted through the window 19 for retaining the plug member 11 rotatably relative to the socket member 12 in a manner hereinafter to be described.

Figure 4:
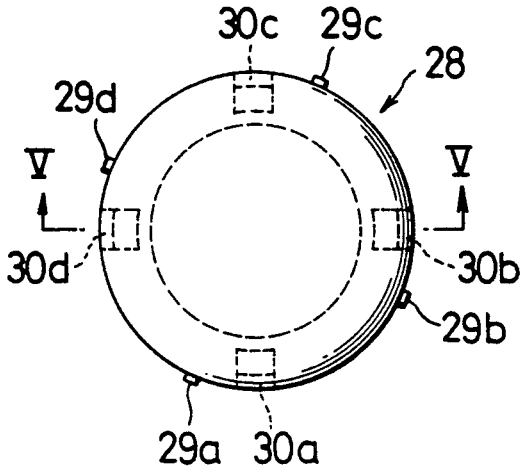
FIG. 4 is a plan view of a retainer means.
Figure 5:
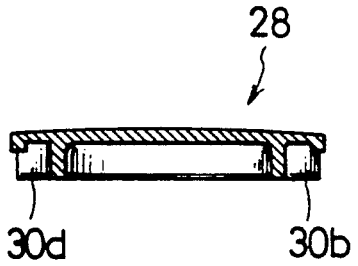
FIG. 5 is a cross-sectional view taken on the line V—V of FIG. 4.

The retainer means or collet 28 is provided equidistantly spaced around its periphery with a plurality of engaging ridges 29*a*–29*d* which register with the engaging notches 21*a*–21*d* in the window 19. The collet 28 is further provided with at least one, preferably four engaging recesses 30*a*–30*d* equidistantly spaced apart but located adjacent to the engaging ridges 29*a*–29*d*, as better shown in FIG. 4, for receptive engagement with a stopper means later described. The collet 28 is still further provided at its bottom with a concentric cavity 31 dimensioned to receive and support therein a coil spring 32 when the latter is seated in the chamber 18 of the plug member 11 as better shown in FIG. 5. The collet 28 has its upper surface preferably rounded off to allow the socket member 12 to smoothly slide thereover.

Figure 6:
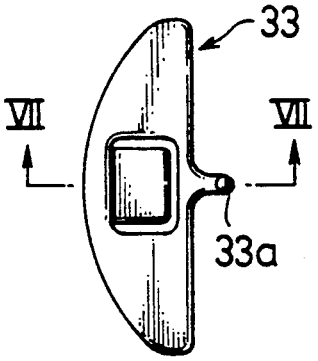
FIG. 6 is a plan view of a stopper means.
Figure 7:
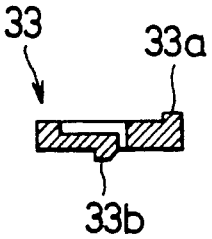
FIG. 7 is a cross-sectional view taken on the line VII—VII of FIG 6.
Figure 8:
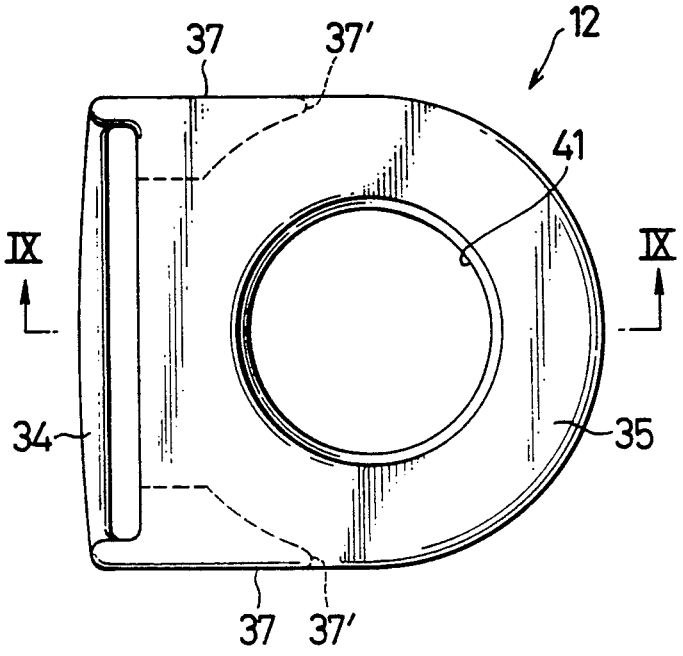
FIG. 8 is a plan view of a socket member constituting a female part of the buckle.
Figure 9:
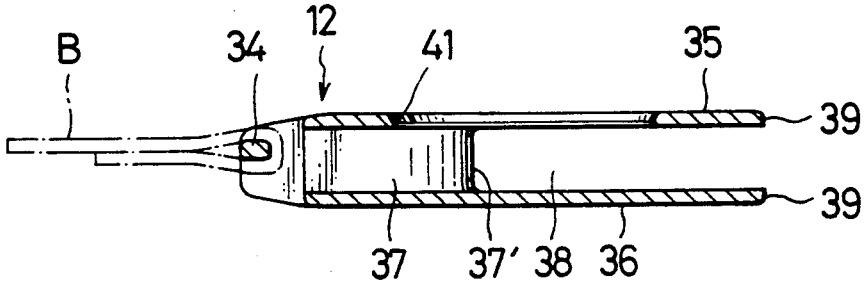
FIG. 9 is a longitudinal cross-sectional view taken on the line IX—IX of FIG. 8.

Designated at 33 is a stopper means which is, as better shown in FIGS. 6 and 7, a crescent-shaped block having a first locking lug 33*a* projecting upwardly from a linear side of the block for engagement with either of the recesses 30*a*–30*d* of the retainer means 28 in a manner hereafter to be described, and a second locking lug 33*b* projecting downwardly from the lower surface of the block for engagement with the locking aperture 24*b* in the lower plate 17 of the plug member 11.

The socket member 12 has a belt retainer 34 at one or rear end thereof for retaining the opposite free end of a belt or the like B in a manner well known in the art. The socket member 12,being generally complimentary in shape with the engaging tongue portion 15 of the plug member 11, is formed by an upper plate 35 and a lower plate 36 joined together by a side peripheral flange 37 to define therebetween a chamber 38 dimensioned to receive the engaging tongue 15 of the plug member 11.

The upper and lower plates 35 and 36 have their respective front ends arcuately shaped as at 39 substantially in conformity with the arcuate abutments 26 of the engaging tongue 15. The peripheral flange 37 has a portion removed to provide two opposite terminal ends 37', 37' defining therebetween an arcuate opening 40 at the arcuate front ends 39 of the plates 35 and 36 in communication with the chamber 38 for receptive engagement with the engaging tongue 15 of the plug member 11.

A circular window 41 is formed in the upper plate 35 in communication with the chamber 38, the window 41 having a diameter substantially equal to or slightly larger than that of the retainer means 28.

With this construction, the buckle 10 is assembled in the following manner.

Figure 10:
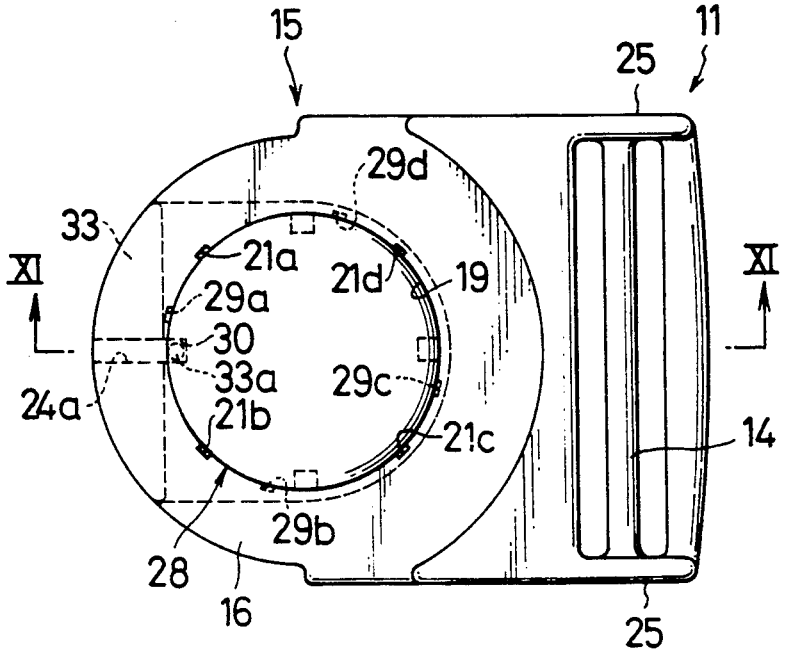
FIG. 10 is a plan view of the plug member shown assembled with the retainer means and the stopper means.
Figure 11:
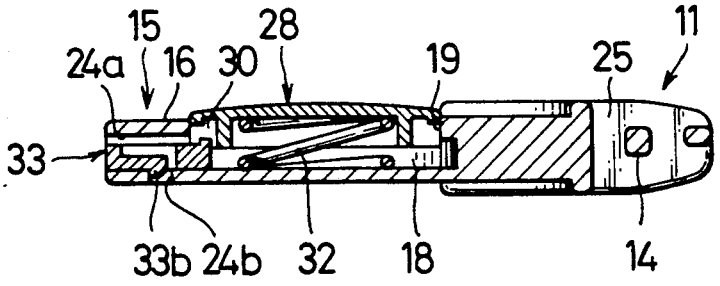
FIG. 11 is a cross-sectional view taken on the line XI—XI of FIG. 10.

The retainer means 28 having the coil spring 32 supported in the cavity 31 is inserted through the window 19 into the chamber 18 of the plug member 11, in which instance the engaging ridges 29*a*–29*d* of the retainer means 28 are brought into registry with the mating notches 21*a*–21*d* in the peripheral edge 20 of the window 19 and the retainer means 28 is then depressed against the tension of the spring 32 until the ridges 29*a*–29*d* sink below the notches 21*a*–21*d*, whereupon the retainer means 28 is rotated in either direction to bring one of its engaging recesses 30*a*–30*d* into alignment with the guide slit 24*a* in the inlet mouth 22 of the engaging tongue 15 as shown in FIG. 10. The stopper means 33 is now mounted in the inlet mouth 22 with its first locking lug 33*a* guided along the slit 24*a* into that one of the engaging recesses 30*a*–30*d* which has been aligned with the slit 24*a*, while the second locking lug 33*b* is received into the locking aperture 24*b* in the tongue 15 as shown in FIG. 11.

Figure 12:
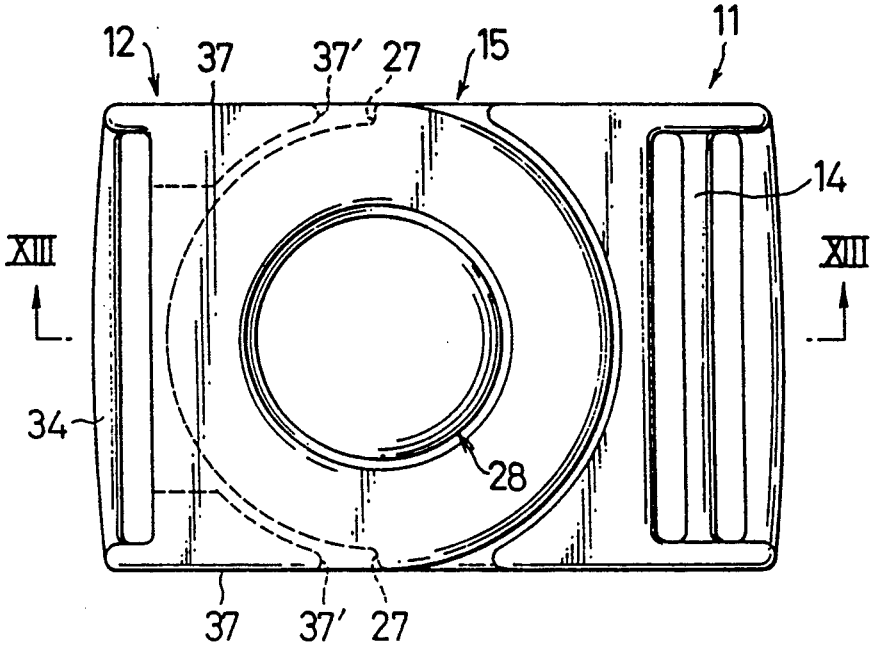
FIG. 12 is a plan view of the buckle shown with its plug and socket members mounted together.
Figure 13:
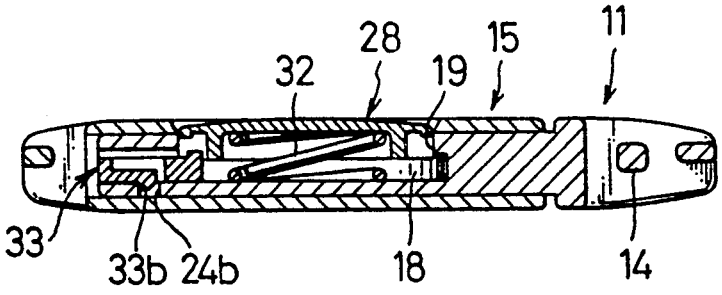
FIG. 13 is a cross-sectional view taken on the line XIII—XIII of FIG. 12.

This is followed by coupling the socket member 12 with the plug member 11, in which instance the engaging tongue 15 is inserted through the arcuate opening 40 fully into the chamber 18 until the retainer means (collet) 28 fits into the window 41 of the socket member 12 as shown in FIGS. 12 and 13. With the plug and socket members 11 and 12 thus coupled together, the terminal ends 37', 37' of the flange 37 of the socket member 12 are spaced apart from the end abutments 27, 27 of the flanges 25, 25 of the plug member 11 by a distance over which the two members 11 and 12 are allowed to rotate relative to each other about the retainer means 28 in a plane parallel to the plane of the buckle 10. This distance therefore can be selected at will to determined the extent of relative rotative movement desired between the plug and socket members 11 and 12.

Releasing the plug member 11 from the socket member 12 is done simply by depressing the retainer member 28 to sink into the chamber 18 below the level of the window 41 against the tension of the spring 32 so that the plug member 11 can be pulled out apart from the socket member 12.

Obviously, various modifications and variations of the present invention are possible in the light of the above teaching. It is therefore to be understood that within the scope of the appended claims the invention may be practiced otherwise than as specifically described.

What is claimed is:

1. A buckle which comprises a plug member and a socket member releasably engageable therewith, said plug member having a circular window and including a retainer means resiliently supported to be movable through said window vertically with respect to the plane of the buckle and a stopper means adapted to hold said retainer means in place against rotation, and said socket member having a chamber dimensioned to receive said plug member and a circular window dimensioned to receive said retainer means movably therein, the arrangement being that said plug member and said socket member are rotatable relative to each other about said retainer means in a plane parallel to the plane of the buckle.

2. A buckle according to claim 1 wherein said plug member is provided around the peripheral edge of said window with a plurality of notches, said retainer means is in the form of a disc-like collet having around its periphery a plurality of ridges disposed in registrable relation to said notches and at least one, preferably a plurality of recesses, and said stopper means has a locking lug engageable in one of said recesses.

3. A buckle according to claim 1 wherein said retainer means is normally urged upwardly by means of a coil spring.

* * * * *